US007942899B2

(12) United States Patent
Huberman et al.

(10) Patent No.: US 7,942,899 B2
(45) Date of Patent: May 17, 2011

(54) TEETHER BOOK

(75) Inventors: Susan Huberman, Rancho Santa Fee, CA (US); Steven Bryan Dunn, Beverly Hills, CA (US)

(73) Assignee: Munchkin, Inc., North Hills, CA (US)

( * ) Notice: Subject to any disclaimer, the term of this patent is extended or adjusted under 35 U.S.C. 154(b) by 1126 days.

(21) Appl. No.: 11/174,871

(22) Filed: Jul. 5, 2005

(65) Prior Publication Data

US 2005/0245968 A1 Nov. 3, 2005

Related U.S. Application Data

(63) Continuation of application No. 09/417,399, filed on Oct. 13, 1999, now abandoned.

(51) Int. Cl.
*A61J 17/00* (2006.01)

(52) U.S. Cl. ..... 606/235

(58) Field of Classification Search ..... 606/234, 606/235; 119/709–711
See application file for complete search history.

(56) References Cited

U.S. PATENT DOCUMENTS

| | | | |
|---|---|---|---|
| 4,063,369 | A | 12/1977 | Hart |
| 4,280,241 | A | 7/1981 | Pfaff |
| 5,217,256 | A | 6/1993 | Lomas |
| D352,062 | S | 11/1994 | Nichols |
| 5,472,364 | A | 12/1995 | Castleman |
| 5,533,758 | A | 7/1996 | Lee |
| 5,871,237 | A | 2/1999 | Hunt |
| 6,061,943 | A | 5/2000 | Pepys |

*Primary Examiner* — Todd E Manahan
*Assistant Examiner* — Michael G Mendoza
(74) *Attorney, Agent, or Firm* — Knoble Yoshida & Dunleavy, LLC

(57) ABSTRACT

A teething toy for infants and small children is styled as an illustrated book. The toy includes a number of page-like leaves, which in the preferred embodiment are fabricated from a cloth-like material, and a number of attached teething elements. The teething elements are preferably made from a relatively hard resilient material that is textured to provide effective teething relief. In one embodiment, the teething elements are integrated into artwork that is printed on the attached page leaf. The teething toy combines effective teething relief for an infant or small child with subtle encouragement to the child that books are worthwhile objects of attention.

26 Claims, 6 Drawing Sheets

TEETHER BOOK

This is a Continuation of Ser. No. 09/417,399, filed Oct. 13, 1999, now abandoned, the entire disclosure of which is hereby incorporated by reference as if set forth fully herein.

BACKGROUND OF THE INVENTION

1. Field of the Invention

This invention relates generally to the field of juvenile products. More specifically, the invention pertains to a teething toy that is styled as a book or similar printed article.

2. Description of the Related Technology

During the first 18 months the average child makes considerable gains in height and weight, begins teething, develops sensory discrimination, and begins to walk and talk. Children usually begin teething with the emergence of the two bottom front teeth, followed about four to eight weeks later by the four upper teeth, and then about one month later by the two lower incisors. The first molars come in next, followed by the canine or eye teeth.

According to the American Academy of Pediatrics, teething occasionally may cause mild irritability, crying, low-grade temperature, excessive drooling, and a desire to chew on something hard. The gums around the new teeth will swell and be tender. Parents and caregivers are encouraged to soothe the child at this stage by gently rubbing or massaging the child's gums with a finger. Teething rings are helpful as well, and are preferably made from a firm material such as rubber.

The U.S. Department of Education and many other authorities encourage parents to "advertise the joy of reading," such as by reading interesting stories and poems to children, beginning at a very early age. With the help of their parents and other caregivers, children can begin a lifelong relationship with the printed word, so they grow into adults who read easily and frequently whether for business, knowledge, or pleasure.

With both parents working in a growing number of families, often time the only or most active period of reading is at bedtime. After reading a book to a baby or toddler prior to bedtime, the parent typically places the baby or toddler into its crib. The baby often at this point is inclined to grab the book that the parent was reading and want to bring it into the bed or the crib. Standard books that are made out of paper and cardboard are not safe to give to a baby or toddler. As babies are teething, they will often place any handy object in their mouths. Paper books may become torn, or may cause a choking hazard.

There are many products on the market that are designed to encourage a love for books in young children. Given the importance of early childhood development to society and individual children alike, though, the development of new ideas and products on this area is to be encouraged. In particular, a need exists for such products that are safer for infants and toddlers than conventional books, and that are less likely to present a choking hazard should an infant or toddler gain possession of the product while unattended, such as while in a crib or a bed.

SUMMARY OF THE INVENTION

It is an object of the invention to provide a teething toy that combines effective teething relief for an infant or small child along with providing subtle encouragement to the child that books are worthwhile objects of attention.

It is further an object to provide a book-like product that is safer for infants and toddlers than conventional books, and that is less likely to present a choking hazard should an infant or toddler gain possession of the product while unattended, such as while in a crib or a bed.

In order to achieve the above and other objects of the invention, a teething toy constructed according to a first aspect of the invention includes a book-like structure having a plurality of leaves; and a teething element that is attached to at least one of the leaves, said teething element being fabricated from a non-toxic material, whereby it will be safe for an infant or small child to place his or her mouth on the teething element.

A book-like article for small children according to a second aspect of the invention includes a plurality of leaves; binding structure for binding the leaves together as a book; and gripping structure, secured near an outer edge of at least one of the leaves, for providing enhanced grippability to the leaf, whereby a small child will be able to turn the leaves of the book-like article like a book.

A book-like article for small children according to a third aspect of the invention includes a plurality of leaves; binding structure for binding the leaves together as a book; and leaf weight structure, secured near an outer edge of at least one of the leaves, for providing enhanced weight to the outer edge area of the leaf, whereby the book-like article will be discouraged from closing when it is laid open in a given position.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
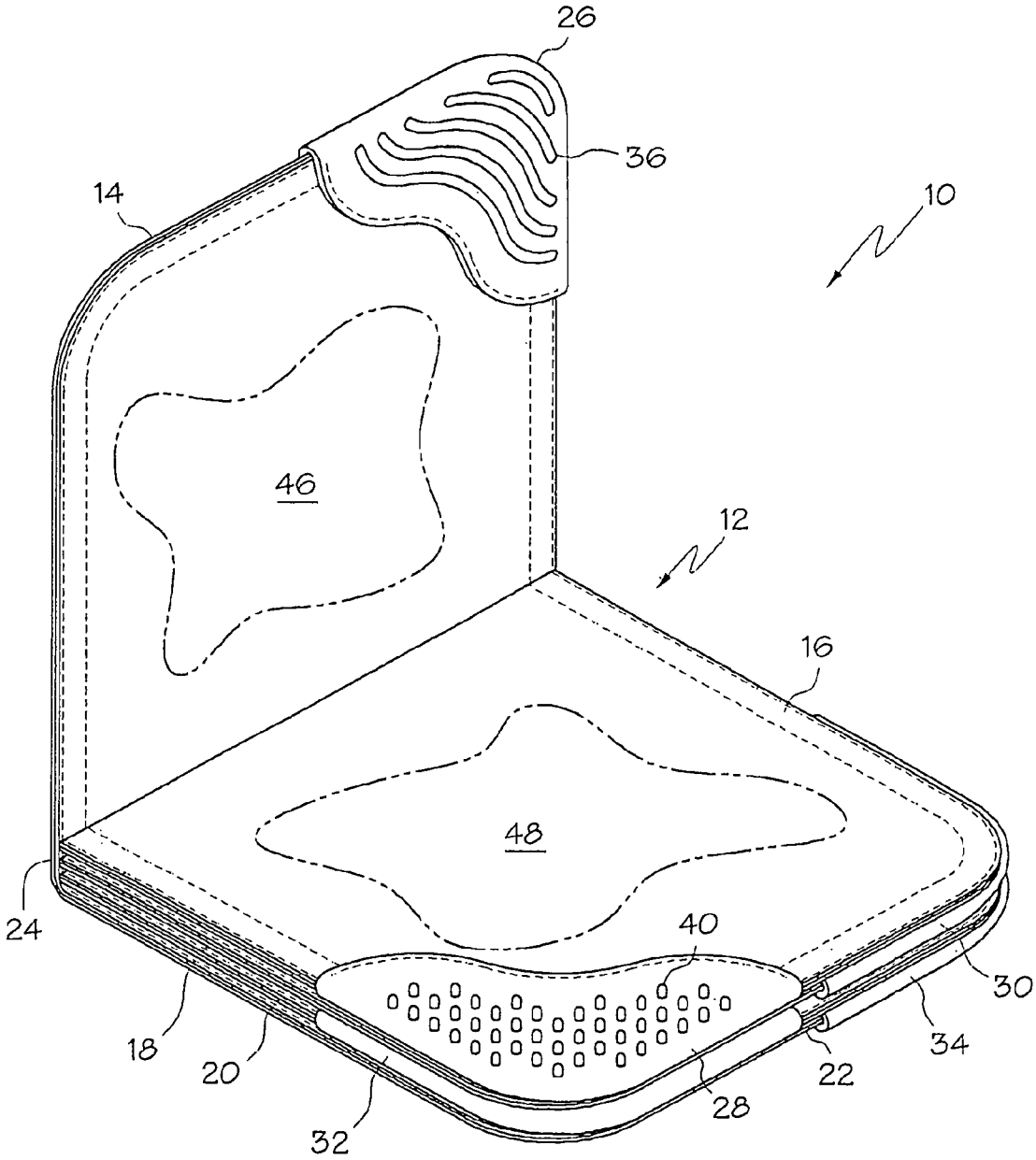
FIG. 1 is a perspective view of a teething toy that is constructed according to a first embodiment of the invention.

Referring now to the drawings, wherein like reference numerals designate corresponding structure throughout the views, and referring in particular to FIG. 1, a teething toy 10 according to a preferred embodiment of the invention includes a book-like structure 12 having a plurality of leaves 14, 16, 18, 20 and 22, each leaf defining a separate page of the book-like structure 12. A binding 24, which may simply be an extension of the first leaf 14, is provided to bind the various leaves together in a book-like configuration, as shown in FIG. 1. Each of the leaves 14, 16, 18, 20 and 22 is generally rectangular (and preferably square) in shape and has an inner edge that is secured to the binding 24, top and bottom edges, and an outer edge that intersects the top and bottom edges respectively at top and bottom outer corners, which are preferably slightly rounded, as may be seen in FIG. 1.

Preferably, each leaf 14, 16, 18, 20 and 22 of the book-like structure 12 is fabricated from a cloth-like material that is stitched about an inner foam core so that the leaves 14, 16, 18, 20 and 22 are soft and compressible for the safety, comfort and enjoyment of the infant or small child. In the preferred embodiment, the inner foam core is fabricated from a polyester foam filling, while the cloth-like material is woven from a blend of natural and artificial fibers that is most preferably 65% polyester and 35% cotton.

Figure 2:
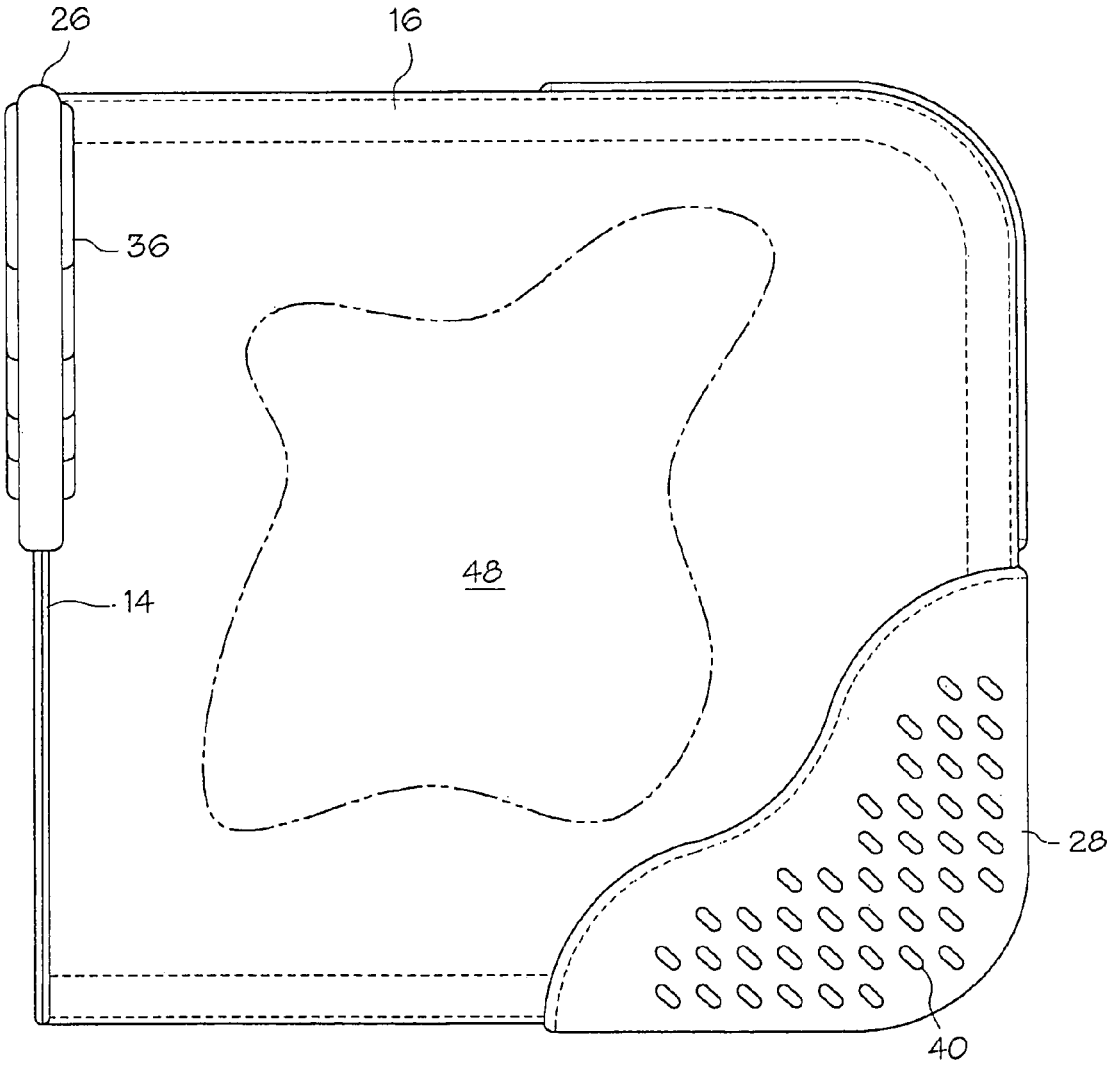
FIG. 2 is a side elevational view of the embodiment shown in FIG. 1.
Figure 3:
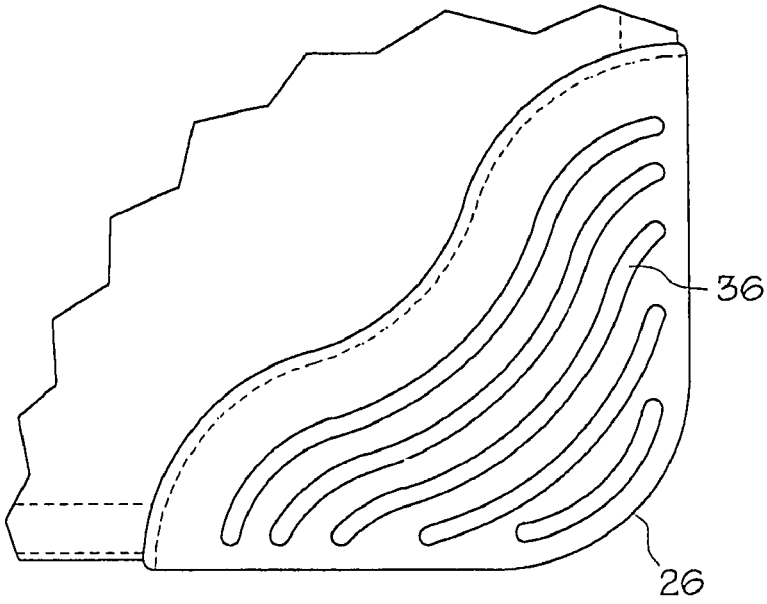
FIG. 3 is a fragmentary view of one component in the embodiment of FIG. 1.

As may be seen in FIGS. 1-3, a teething element 26 is attached to the top outer corner of the first leaf 14 in such as way as to substantially overlap with the leaf 14, in other words so it does not extend for a substantial distance outwardly from the leaf 14. Teething element 26 preferably has an interior slot for receiving the top outer corner of leaf 14 so as to surround and overlay both the front and back surfaces of the leaf 14, and is secured to the leaf 14 by a reinforced sewn stitching. In addition to providing a teething surface for infants and small children, the presence of the teething elements makes it easier for small hands to grip and turn the leaves of the book-like structure 12. In addition, the weight of the teething elements tend to keep the pages of the book-like structure from flipping or closing, making it easier to keep from losing ones place. Adults will also find the pages easier to grip and turn, particularly in instances when the adult suffers from diminished dexterity as a result of as a result of old age or disability, or when he or she is trying to manipulate the book-like article with only one hand.

Teething element 26 is preferably fabricated from a firm, resilient elastomeric material such as ethylene vinyl acetate or Krayton™, which is commercially available from Shell Chemical Company. Teething element 26 is non-toxic, and is sized and dimensioned to be comfortably inserted into an infant's mouth for teething purposes. It is further constructed and arranged to have no sharp edges capable of injuring the user, and also have at least one non-smooth textured or bumpy surface, which will be discussed in greater detail below. Teething element 26 is further sized and configured so as not to present a choking hazard to an infant or small child. In the preferred embodiment, the teething element 26 is so sized and configured so as not to be capable of entering and penetrating to its full depth an opening in a test fixture that is 30 mm in depth, 35 mm in height, and 50 mm in width, with the ends of the width being curved at a radius of 17.5 mm. To further ensure that teething elements 26 is sized and configured so as not to present a choking hazard to an infant or small child, it is also sized and configured so as not to enter and penetrate to its full depth a cylindrical cavity in a test fixture that has a depth of 30 mm, and a circular opening having a diameter of 42.7 mm. The aforementioned criteria are consistent with the guidelines of the Consumer Product Safety Commission and the American Society of Testing and Materials.

As may best be seen in FIG. 1, the second teething element 28 is secured to the bottom outer corner of the second leaf 16, while a third teething element 34 is secured to a top outside corner of the third leaf 18. Similarly, a fourth teething element 32 is secured to a bottom outside corner of the fourth leaf 20, while a fifth teething element 34 is secured to the top outside corner of the fifth leaf member 22. Teething elements 28, 30, 32 and 34 are constructed and secured to their corresponding leaves exactly as described above with respect to teething element 26, with the exception of the texture that is provided on the different teething elements, which will be discussed in greater detail below.

Figure 4:
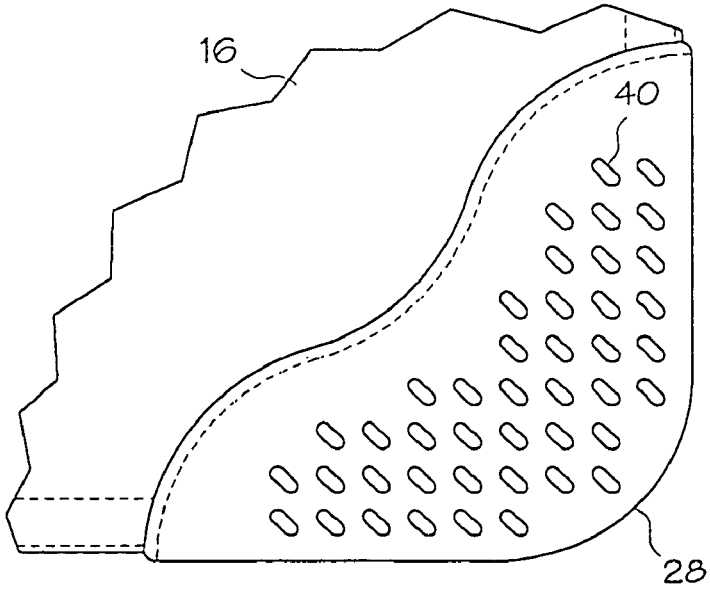
FIG. 4 is a fragmentary view of another component in the embodiment of FIG. 1.
Figure 5:
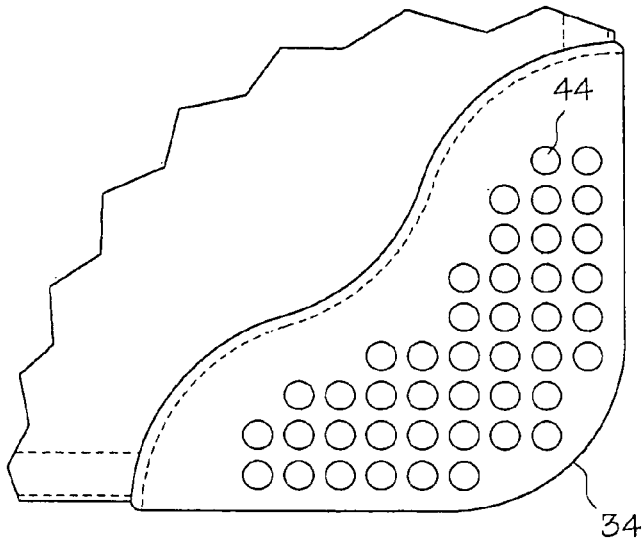
FIG. 5 is a fragmentary view of another component in the embodiment of FIG. 1.

An as may best be seen in FIGS. 1 and 3, the first teething element 26 is provided with a first texture 36, which can best be described as a continuous wavy pattern. A second texture 40, which can best be described as the superimposition of a number of commonly-oriented pill capsule-shaped bumps is provided on the first and second surfaces of the second teething elements 28 and the third teething elements 30. This pattern is best shown in FIG. 4 of the drawings. A third texture 44, which may be described as a pattern of raised circular dots, is provided on the inner and outer surfaces of the fourth and fifth teething elements 32, 34. Each of the first, second and third preferred textures 36, 40, 44 is raised with respect to the base surface of the corresponding teething element so as to protrude upwardly or downwardly from the base surface by a distance of at least 0.5 mm. It should be recognized that the textures shown in the preferred embodiment of the invention are exemplary only, and an unlimited number of different textures may alternatively be provided on one or more of the teething elements within the overall scope of the invention.

Figure 6:
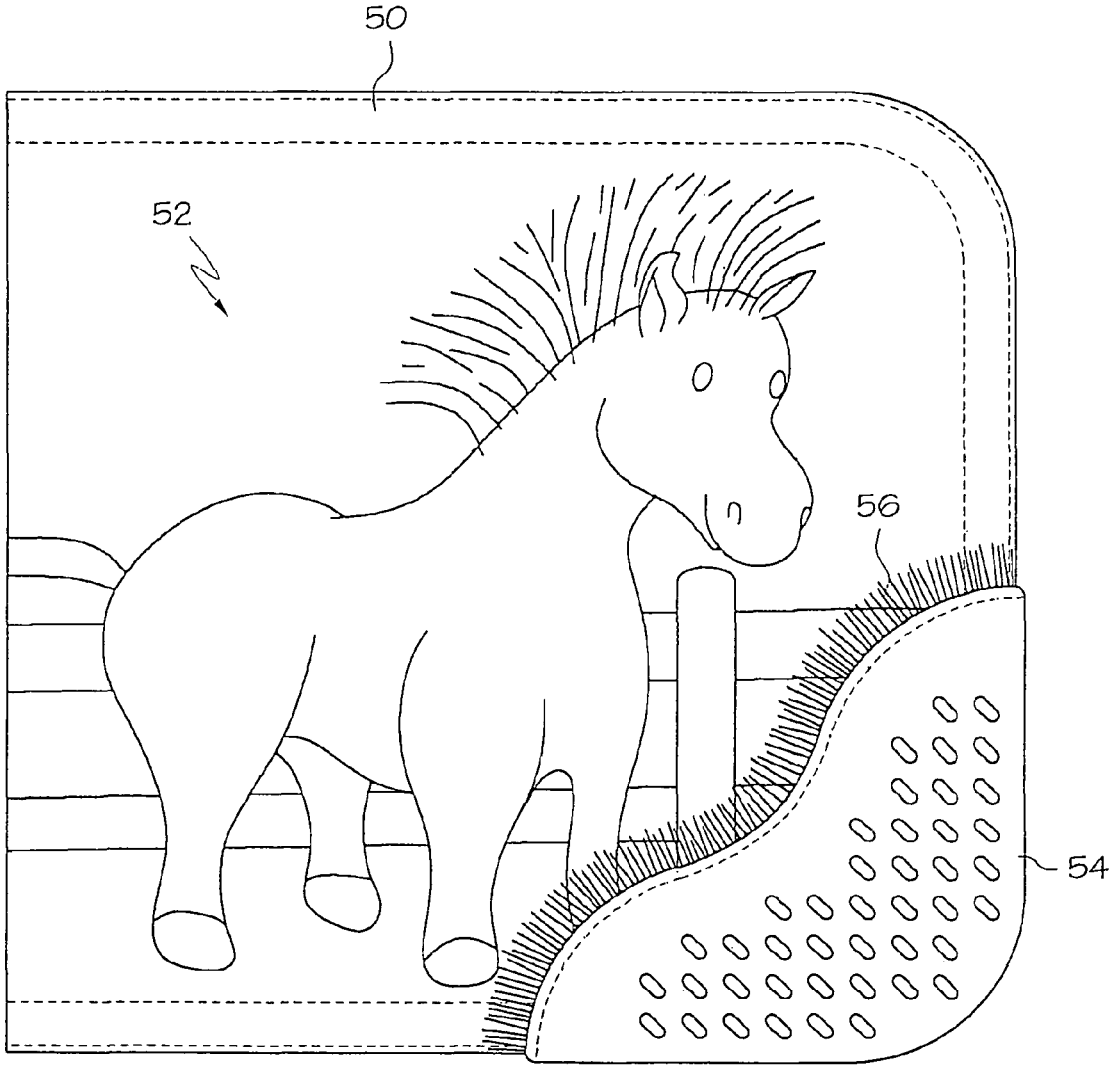
FIG. 6 is a plan view depicting an alternative embodiment of one component in the article that is depicted in FIG. 1.

As may be seen in FIG. 1, a first example of artwork 46 is printed on the second surface of the first leaf 14, and a second example 48 of artwork is similarly printed on the first surface of leaf 16. Artwork such as this is preferably printed on all of the different sides of the various leaves throughout the entire book-like structure 12, and may but will not necessarily include writing as well, so that the parent or caregiver can actually read the book-like structure to the infant. The art work is preferably styled so as to encourage the parent or caregiver to create stories, or point out and name objects, or to otherwise verbally engage the child. According to one important aspect of an alternative embodiment of the invention, the artwork may be integrated into the teething element so that the teething element appears to be an integral part of the artwork itself. For example, FIG. 6 illustrates one embodiment of the invention wherein the art work 52 includes a teething element 54 that is made to appear as if it is part of a pile of hay that a horse in the artwork 52 is preparing to eat. In this embodiment, the teething element 54 may further be colored bright yellow, so as to blend in with the pile of hay 56 that is shown in the artwork 52.

Figure 7:
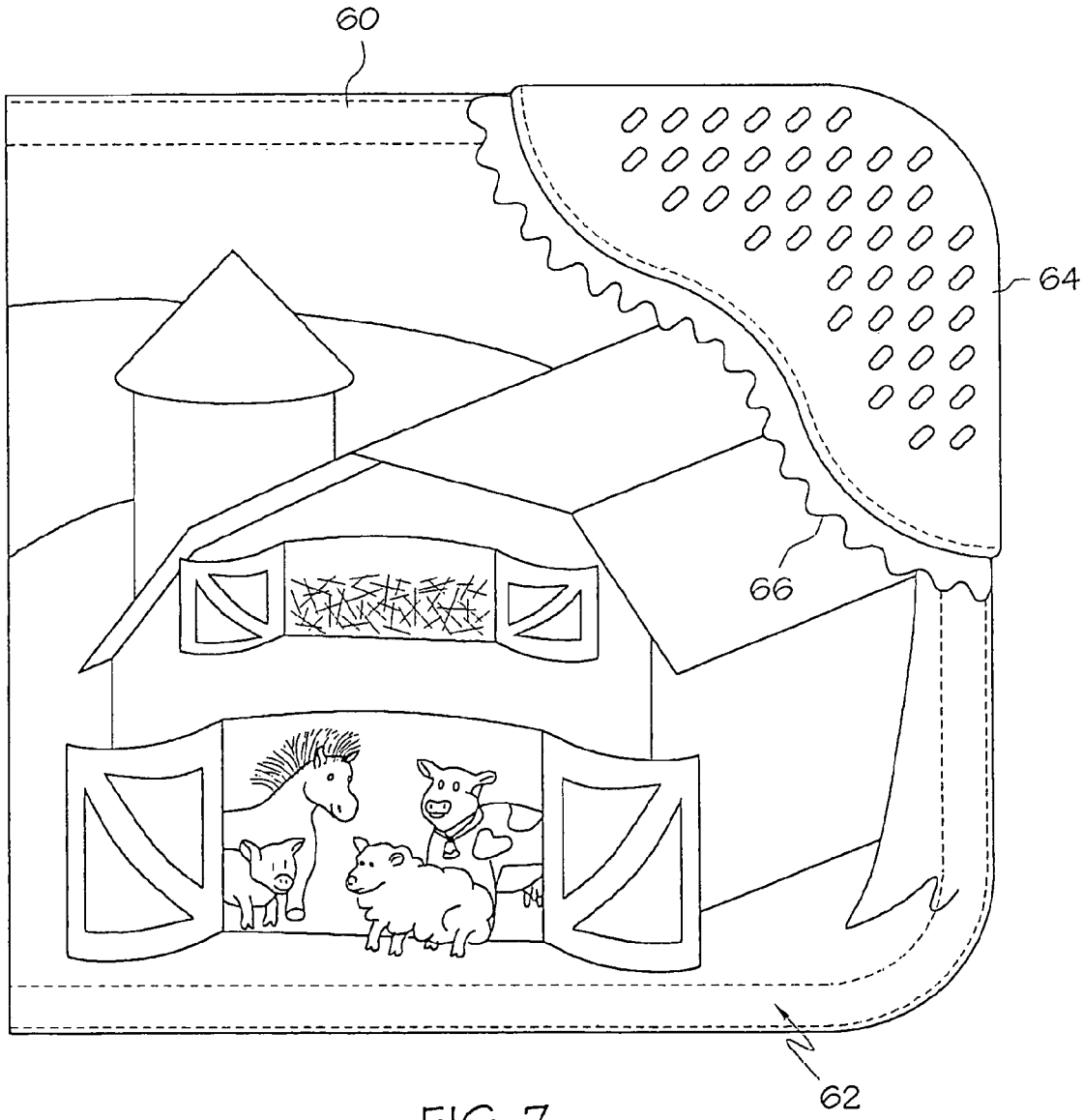
FIG. 7 is a plan view depicting another embodiment of one component in the embodiment of FIG. 1.

In the embodiment that is depicted in FIG. 7, a leaf 60 is provided with artwork 62 that includes a barn that is partially covered by a tree 66. In this example, the teething element 64 is made to appear to be part of the tree 66, and is preferably colored so as to be bright green, thereby representing the color of the leaves that are on the tree 66. The texture of the teething elements 64 may also be made consistent with the expected leaf like structure of the tree.

Figure 8:
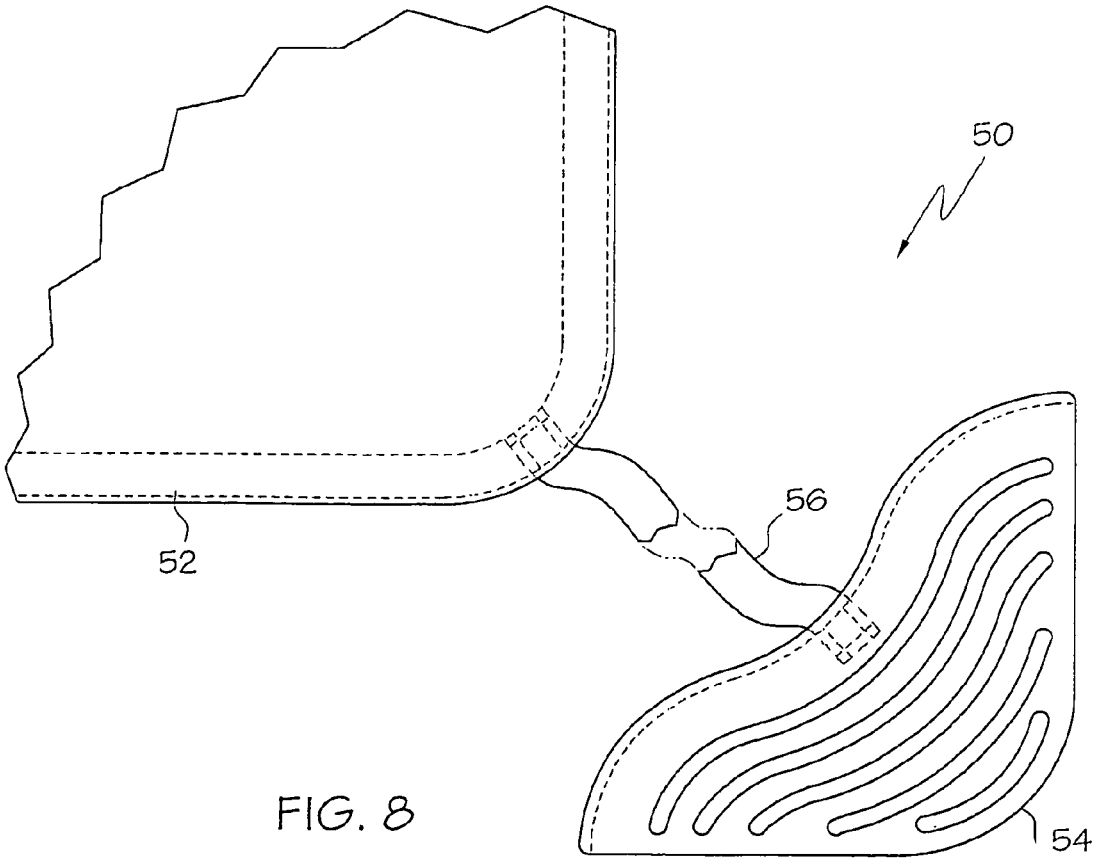
FIG. 8 is a fragmentary view of yet another embodiment of the invention.

In another embodiment of the invention, is illustrated in FIG. 8, teething elements 54 could be attached to the book-like structure 50 by a tether 56, such as a string or a ribbon, which can also act as a bookmark for parents or caregivers. In the embodiment of FIG. 8, the tether 56 is secured to a leaf 52 of the book-like structure, but it should be understood that the tether could alternatively be attached to another part of the book-like structure, for example the binding.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A teething toy, comprising:

a book-like structure having a binding and a plurality of leaves; and an elastomeric teething element that is directly attached to one of said leaves opposite the binding, said elastomeric teething element being fabricated from a resilient, non-toxic material;

said elastomeric teething element further being sized and configured so as not to be capable of entering and penetrating to its full depth an opening in a test fixture that is 30 mm in depth, 35 mm in height, and 50 mm in width, with the ends of the width being curved at a radius of 17.5 mm;

said elastomeric teething element further being sized and configured so as not to enter and penetrate to its full depth a cylindrical cavity in a test fixture that has a depth of 30 mm, and a circular opening having a diameter of 42.7 mm;

said elastomeric teething element further being sized and dimensioned to be comfortably inserted into an infant's mouth for teething purposes;

said teething element further having no sharp edges capable of injuring an infant, whereby it will be safe for an infant or small child to place his or her mouth on said teething element.

2. A teething toy according to claim 1, further comprising artwork that is provided on at least one of said leaves.

3. A teething toy according to claim 2, wherein said teething element is integrated into said artwork so that said teething element appears to be part of said artwork.

4. A teething toy according to claim 1, wherein said at least one leaf has a corner area, and wherein said teething element is secured directly to said corner area.

5. A teething toy according to claim 1, wherein said teething element is shaped so as not to substantially extend outwardly from said leaves.

6. A teething toy according to claim 1, wherein at least one of said leaves comprises a cloth material.

7. A teething toy according to claim 1, wherein a plurality of said elastomeric teething elements are provided.

8. A teething toy according to claim 1, wherein said elastomeric teething element is textured so as to provide teething relief to an infant or small child when chewed on, and wherein said texture is selected from the group of consisting of a wavy pattern, a plurality of pill capsule shaped bumps and a pattern of raised circular dots.

9. A teething toy according to claim 1, wherein said elastomeric teething element is positioned in a location so as to also be functional as a gripping aid for aiding users to turn at least one of the leaves.

10. A teething toy according to claim 9, wherein said elastomeric teething element is weighted to keep the book-like structure from closing when it is laid open.

11. A teething toy according to claim 1, wherein said elastomeric teething element has an interior slot defined therein, and wherein a portion of said at least one of said leaves is secured within said interior slot.

12. A teething toy according to claim 11, wherein an outer corner portion of said at least one of said leaves is secured within said interior slot.

13. A teething toy according to claim 1, wherein said elastomeric teething element is secured to said at least one of said leaves by stitching.

14. A teething toy according to claim 1, wherein said at least one of said leaves is compressible and comprises a fabric material.

15. A book-like article for small children, comprising:

a plurality of leaves;

binding means for binding said leaves together as a book; and elastomeric gripping means, secured to an outer edge of at least one of said leaves opposite said binding means, for providing enhanced grippability to the leaf, said elastomeric gripping means comprising teething means for permitting an infant to safely teethe thereon, said teething means comprising an elastomeric teething element that is fabricated from a resilient, elastomeric nontoxic material;

said elastomeric teething element further being and being sized and configured so as not to be capable of entering and penetrating to its full depth an opening in a test fixture that is 30 mm in depth, 35 mm in height, and 50 mm in width, with the ends of the width being curved at a radius of 17.5 mm;

said elastomeric teething element further being sized and configured so as not to enter and penetrate to its full depth a cylindrical cavity in a test fixture that has a depth of 30 mm, and a circular opening having a diameter of 42.7 mm;

said elastomeric teething element further being sized and dimensioned to be comfortably inserted into an infant's mouth for teething purposes;

said elastomeric teething element further having no sharp edges capable of injuring an infant, whereby a small child will be able to teethe and to easily turn the leaves of the book-like article like a book; and wherein the elastomeric teething element is textured so as to provide teething relief to an infant or small child when chewed on, wherein said texture is selected from the group consisting of a wavy pattern, a plurality of pill capsule shaped bumps and a pattern of raised circular dots.

16. A book-like article according to claim 15, wherein said elastomeric gripping means is secured near a corner portion of the leaf.

17. A book-like article for small children according to claim 15, wherein said elastomeric teething element has an interior slot defined therein, and wherein said outer edge of said at least one of said leaves is secured within said interior slot.

18. A book-like article for small children according to claim 17, wherein an outer corner portion of said at least one of said leaves is secured within said interior slot.

19. A book-like article for small children according to claim 15, wherein said elastomeric teething element is secured to said at least one of said leaves by stitching.

20. A book-like article for small children according to claim 15, wherein said at least one of said leaves is compressible and comprises a fabric material.

21. A book-like article for small children, comprising:

a plurality of leaves;

binding means for binding said leaves together as a book; and elastomeric leaf weight means, secured near an outer edge of at least one of said leaves opposite said binding means, for providing enhanced weight to the outer edge area of the leaf, said leaf weight means comprising an elastomeric teething element that is fabricated from a resilient elastomeric nontoxic material;

said elastomeric teething element further being and being sized and configured so as not to be capable of entering and penetrating to its full depth an opening in a test fixture that is 30 mm in depth, 35 mm in height, and 50 mm in width, with the ends of the width being curved at a radius of 17.5 mm;

said elastomeric teething element further being sized and configured so as not to enter and penetrate to its full depth a cylindrical cavity in a test fixture that has a depth of 30 mm, and a circular opening having a diameter of 42.7 mm;

said elastomeric teething element further being sized and dimensioned to be comfortably inserted into an infant's mouth for teething purposes;

said elastomeric teething element further having no sharp edges capable of injuring an infant, whereby the book-like article will function as a teether, said leaf weight means providing sufficient weight whereby said book-like article will be discouraged from closing when it is laid open in a given position;

wherein said teething element is textured so as to provide teething relief to an infant or small child when chewed on; and wherein said texture is selected from the group of consisting of a wavy pattern, a plurality of pill capsule shaped bumps and a pattern of raised circular dots.

22. A book-like article according to claim 21, wherein said leaf weight means is secured near a corner portion of the leaf.

23. A book-like article for small children according to claim 21, wherein said elastomeric teething element has an interior slot defined therein, and wherein said outer edge of said at least one of said leaves is secured within said interior slot.

24. A book-like article for small children according to claim 23, wherein an outer corner portion of said at least one of said leaves is secured within said interior slot.

25. A book-like article for small children according to claim 21, wherein said elastomeric teething element is secured to said at least one of said leaves by stitching.

26. A book-like article for small children according to claim 21, wherein said at least one of said leaves is compressible and comprises a fabric material.

* * * * *